United States Patent [19]

Mendelevitch

[11] Patent Number: 4,718,871

[45] Date of Patent: Jan. 12, 1988

[54] AQUATIC GROWTH CUTTER

[76] Inventor: Eli Mendelevitch, 1920 Una St., San Diego, Calif. 92113

[21] Appl. No.: 843,309

[22] Filed: Mar. 24, 1986

[51] Int. Cl.[4] ..... B63H 5/16

[52] U.S. Cl. ..... 440/71; 440/72; 440/73; 114/42; 114/140; 114/22 R; 114/221 A; 114/240 A; 114/240 B

[58] Field of Search ..... 440/71, 72, 73; 114/40, 114/41, 42, 140, 221 A, 240 R, 240 A, 240 B, 20.3; 172/39, 81, 547, 192; 83/928; 30/379, 379.5, 296 R

[56] References Cited

U.S. PATENT DOCUMENTS

| | | | |
|---|---|---|---|
| 1,214,238 | 1/1917 | Taubert | 114/221 A |
| 1,931,772 | 10/1933 | Simpson et al. | 114/221 A |
| 2,054,374 | 9/1936 | Fuller | 440/71 |
| 2,355,842 | 8/1944 | Arado | 440/71 |
| 2,690,728 | 10/1954 | Cavanaugh | 440/73 |
| 4,565,533 | 1/1986 | Springer | 440/71 |

FOREIGN PATENT DOCUMENTS

| | | | |
|---|---|---|---|
| 2001918 | 7/1970 | Fed. Rep. of Germany | 114/41 |
| 1731 | of 1885 | United Kingdom | 114/20.3 |
| 18113 | of 1908 | United Kingdom | 114/20.3 |

*Primary Examiner*—Joseph F. Peters, Jr.
*Assistant Examiner*—Thomas J. Brahan
*Attorney, Agent, or Firm*—Ralph S. Branscomb

[57] ABSTRACT

An upper and a lower blade are fixed together at an adjustable angle and have means for mounting same on the leading edge of the propeller drive housing of an inboard/outboard motor to cut kelp and other seaweed which would otherwise foul the prop and clog the cool, sea water input vents. The cutter has adjustable brackets which will accommodate a wide variety of different types of propeller drive housings, and will accommodate outboard motors as well as inboard motors, and will even fit on the advance edge a sailboat keel. In one embodiment, it has a combination brace/mesh screen which extends from the cutter to the propeller drive housing in front of the cooling water inlets to keep bits of seaweed and other debris from entering and clogging the cooling system, causing overheating the destruction of the motor.

8 Claims, 12 Drawing Figures

AQUATIC GROWTH CUTTER

BACKGROUND OF THE INVENTION

The invention is in the field of marine drive units, and specifically pertains to inboard/outboard drives, although it also has application to outboard motors and sailboats.

The utilization of open, rotating propellers under water engenders the potential problem of fouling the propeller with seaweed such as kelp, fishing lines, and other debris that is increasingly found in the world's oceans. In addition to the problem of wrapping around the propeller, and thus slowing it down, and fouling the drive unit in general, seaweed wrapped around the breathing ports of the propeller drive housing may cut off the cool water circulation which is relied upon by the engine manufacturers to maintain the engine within its range of operating temperatures. If the operator does not become aware of this blocking or clogging, the mechanism can be severely damaged or even ruined before it becomes apparent that there is a problem.

Otherwise, the fouling can slow down the vessel, and cause the operator to spend a few minutes manually unclogging the propeller and unwinding any coiled seaweed.

Devices have been created which are directed toward the solution to that problem. For example, cutting blades are shown in U.S. Pat. No. 2,670,728, issued on June 26, 1951, and U.S. Pat. No. 2,470,874, issued on June 15, 1946. Although no doubt these devices would be useful in some circumstances, they were designed particularly for outboard motors before the popularity of the inboard/outboards, and they lack the versatility and mounting that is required to accommodate the variety of both inboard and outboard motors, as well as the older outboard. They also do not specifically provide for means to screen out debris which would block or clog the vent holes of the cooling system.

Additionally, there is a device that operates on a different principle known as a Spurs cutter, manufactured by Spurs Marine Manufacturing of Fort Lauderdale, Fla. The Spurs cutter utilizes a stationary cutter with several radial blades, and a rotary cutter which has a scissor like action against the stationary blades to cut seaweed and fishing line, which would wind around and foul the propeller. This apparatus, as others mentioned above, does not address vent clogging. Also, it is specific to the fouling that occurs by the winding of seaweed and cord around the propeller, rather than the problem of fouling the propeller drive housing in general.

There is a need, therefore, for a marine growth cutter which is adaptable to virtually and inboard/outboard motor, or outboard motor, and which protects the entire, or virtually the entire immersed propeller drive housing, and which specifically addresses the problem of the ingress of debris into the cooling vents of the drive housing.

SUMMARY OF THE INVENTION

The instant invention fulfills the above stated needs by utilizing a pair of cutting blades, an upper blade and a lower blade, which are adjustably fixed together at a selected one of an unlimited variety of angles. Both the upper blade and the lower blade have mounts which mount on the propeller drive housing, and both of the mounts are vertically adjustable on their respective blades to accommodate different housings. The mounts straddle portions of the propeller drive housing and at least the upper mount is width-wise adjustable to spand the girth of any housing, and mount to opposite sides of the cavitation plate.

In the preferred embodiment, the upper blade mounts a pair of screens which extend in opposite directions to spand the fresh water inlet holes of the cooling system.

DETAILED DESCRIPTION OF THE PREFERRED EMBODIMENT

Figure 1:
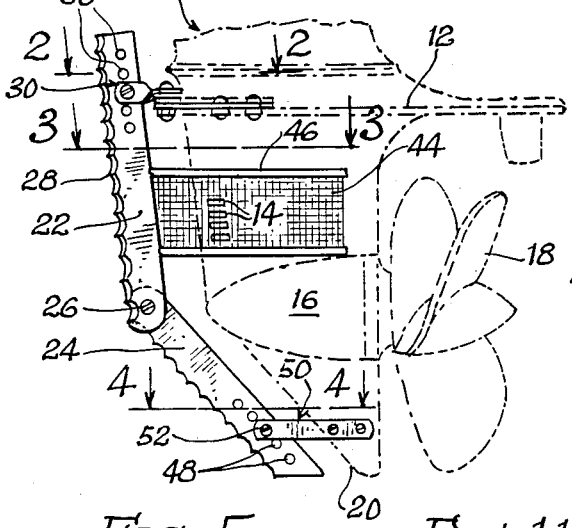
FIG. 1 is a side elevation view illustrating a propeller drive housing in phantom to which the preferred embodiment of the aquatic growth cutter is mounted.

The propeller drive housing 10 extends into the water with a generally streamlined shape, and has a horizontal cavitation plate 12, inlet ports 14 for the cooling system, a gear box hub 16, a propeller 18, and a stabilizing fin or skeg 20.

The aquatic growth cutter of the instant invention includes an upper blade 22 and a lower blade 24, the blades being connected together at selectable angles, such as by means of the nut and bolt 26, which define the pivot joint between the two blades through the appropriate bolt holes. The blades have a leading edge which is serrated as indicated at 28, for better cutting action into the kelp or seaweed, or whatever debris the device encounters. Alternative cutting edges are shown in FIG. 1*a*, where a standard straight knife edge is illustrated, and FIG. 1*b*, illustrating a jagged or saw-toothed cutting edge. Because of the tearing action used by the serrated or saw-toothed edge, in addition to the cutting action, these types of blades would last longer between sharpenings.

Figure 1A:
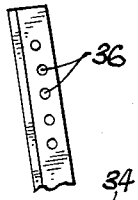
FIG. 1*a* is a detail of the upper portion of a blade having a straight leading edge rather than a serrated leading edge.
Figure 2:
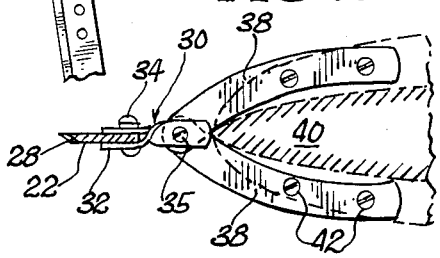
FIG. 2 is a section taken along line 2—2 of FIG. 1.
Figure 3:
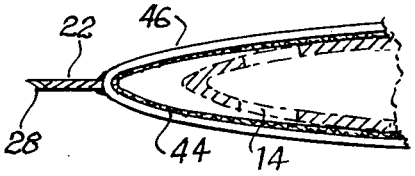
FIG. 3 is a sectional view taken along line 3—3 of FIG. 1.
Figure 1B:
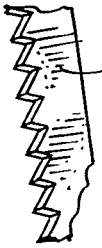
FIG. 1*b* illustrates a modification of the blade in which the leading edge is saw-toothed rather than being serrated or straight.

The upper blade 22 is connected to the housing 10 by means of a mounting clamp 30, seen in FIG. 1 and even better in FIG. 2. The upper mounting clamp 30 of the preferred embodiment is a wishbone-type clamp, having a forward portion 32 comprising a pair of twisted brackets that twist from the horizontal forwardly to the vertical and span the upper blade 28, to which it is bolted at 34. As indicated at 36, the upper blade is provided with a series of vertically spaced boltholes so that the clamp 30 is vertically adjustable on the blade.

Centrally of the clamp 30, there is a vertical pivot defined by yet another bolt 35 which passes through the horizontal tabs of the twisted members and through the front ends of the arms 38 of the wishbone which forms the clamp 30. The arms 38 are thus freely adjustable in and out to accommodate the varying thicknesses of the portion 40 of the housing just above the cavitation plate, with the forward portions of the arms being provided with boltholes so that they can be bolted as at 42 directly to the cavitation plate.

Lower on the upper blade 22, there is mounted a U-shaped filter element 44 which spans around both sides of the housing 10 at the level of the inlet ports 14 to prevent materials which would otherwise clog the cooling system from ever entering these ports. The screen is reinforced at its upper and lower edges by bow-shaped members 46 so that the screen element doubles as a support for the upper cutting blade.

Figure 4:
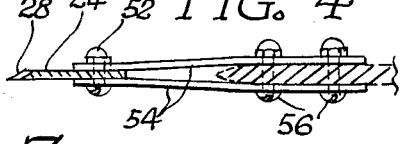
FIG. 4 is a section taken along line 4—4 of FIG. 1.

At the lower end of the unit, the lower blade is provided with a series of selectable vertical apertures 48 to which the lower mounting bracket 50 is bolted at 52. This element, as shown from the top in FIG. 4, actually comprises two separate arms 54 which span the skeg 20 and are bolted to it at 56.

Because of the design of the aguatic growth cutter, it is adjustable to fit virtually any propeller drive housing of any inboard/outboard, or any outboard motor. It is adjustable not only in the vertical points of attachment by virtue of the selectable bolt holes 36 and 48 of the upper and lower cutting blades, respectively, but the upper mounting bracket 30 has the expandable arms 38, and the lower mounting bracket 50 has separate, expandable arms 54 to accommodate varying thicknesses of the housing. The cutter is adjustable to accommodate skegs of different rake by virtue of the pivotal connection 26 between the upper and lower blades. Thus, any conceivable configuration of housing can be matched by the invention.

Figure 5:
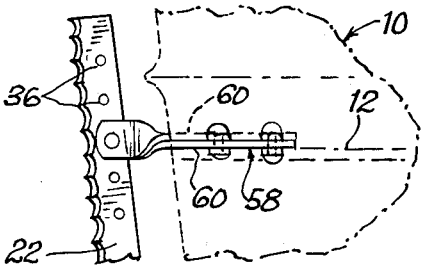
FIG. 5 is a fragmatic side elevational view illustrating a modification of the upper mounting bracket of FIG. 1.

A slight modification is shown in FIG. 5, in which the mounting clamp 30 is replaced with mounting clamp or bracket 58, which only utilizes two twisted arms 60 to pass from the vertical orientation of the cutting blade to the horizontal extension necessary to enable it to be bolted to the cavitation plate. Although the expansion of the individual members 60 would not be as great as the separation that is possible for the arms 38, nonetheless, a certain amount of variation would be accommodated.

Figure 6:
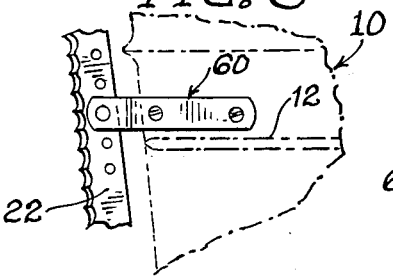
FIG. 6 is a view similar to FIG. 5 illustrating another modification of the upper mounting bracket.
Figure 7:
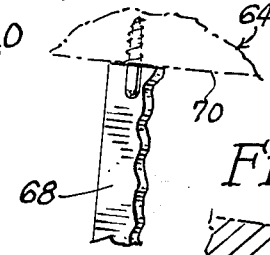
FIG. 7 is a detail illustrating a rear cutting blade of FIG. 10.
Figure 8:
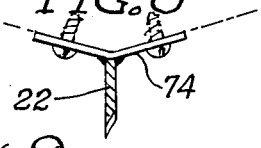
FIGS. 8 and 9, respectively, are sections taken along lines 8—8 and 9—9 of FIG. 10.
Figure 9:
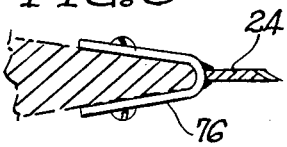
Figure 10:
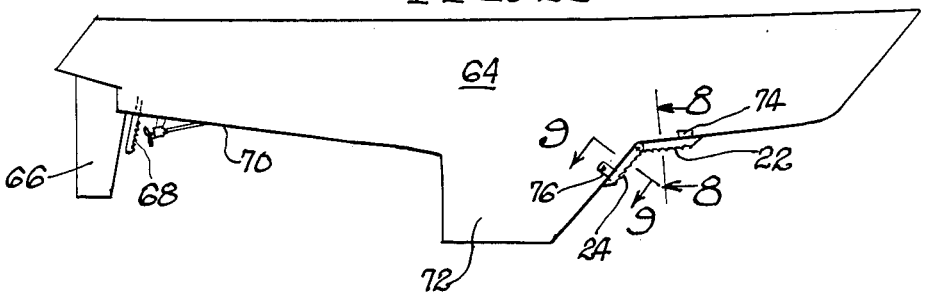

Yet another means of mounting the upper blade is shown in FIG. 6, in which a yoke 62, much like the lower mounting bracket 50, connects the lower blade to the upright portion of the housing just above the cavitation plate 12.

FIGS. 7 through 10 relate to accommodating the cutter to a keel-type sailboat indicated at 64. In this embodiment, the rudder 66 would be protected from fouling by a blade 68 screwed directly into the bottom 70 of the boat. The dual-bladed cutter of the instant invention is swiveled to match the contour along the vertical centerline between the front of the keel 72 and the front of the boat's bottom. The upper blades 22 and 24 are mounted to the respective surfaces of the sailboat by means of yokes 74 and 76, respectively, which are screwed, bolted, or otherwise attached to the boat as needed. The yokes as shown in the drawings are connected to the blades by welding.

The utilization of the dual, pivotal blade structure provides a versatile and effective aquatic growth cutter which need not be manufacturer-specific, but can be provided in one, or a small number, of models to fit virtually any kind of inboard/outboard drive, outboard motors, jet boats, and even with some modification, the leading edge of the keel of a sailboat.

The invention thus being described and illustrated, I hereby claim as follows:

What is claimed is:

1. An aquatic growth cutter for a submerged, water-parting portion of a vessel comprising:

(a) an upper blade having a sharp leading edge:

(b) a lower blade having a sharp leading edge and rigidly depending from said upper blade a fixed, wide oblique angle thereto;

(c) upper mounting means mounting said upper blade to said vessel;

(d) lower mounting means mounting said lower blade to said vessel, said upper and lower mounting means mounting said blades such that same are substantially in advance of said water-parting portion of a vessel to cut aquatic growth as said vessel moves through the water; and (e) said upper blade and lower blade being adjustably pivotally fastened together to be releasable from their fixed relation with one another to pivot in the same plane and including means to fix same together, after being released and adjusted, at a selected angle.

2. An aquatic growth cutter for a submerged, water-parting portion of a vessel comprising:

(a) an upper blade having a sharp leading edge:

(b) a lower blade having a sharp leading edge and rigidly depending from said upper blade a fixed, wide oblique angle thereto;

(c) upper mounting means mounting said upper blade to said vessel;

(d) lower mounting means mounting said lower blade to said vessel, said upper and lower mounting means mounting said blades such that same are substantially in advance of said water-parting portion of a vessel to cut aquatic growth as said vessel moves through the water; and (e) said blades being vertically oriented and at least one of said mounting means has vertically adjustable means of attachment for fastening same to the respective one of said blades.

3. An aquatic growth cutter for mounting on a propeller drive housing having a cavitation plate, said cutter comprising:

(a) an upper blade having a sharp leading edge;

(b) a lower blade having a sharp leading edge and depending from said upper blade;

(c) upper mounting means mounting said upper blade to said vessle; and (d) lower mounting means mounting said lower blade to said vessel, said upper and lower mounting means mounting said blades such that same are substantially in advance of said water-parting portion of a vessel to cut aquatic growth as said vessel moves through the water;

(e) said upper blade and lower blade being pivotally fastened together to pivot in the same plane and including means to fix same together at a selected angle;

(f) said blades each being elongated to define elongated leading edges and said edges are scalloped;

(g) said blades being vertically oriented and at least one of said mounting means having vertically adjustable means of attachment for fastening same to the respective one of said blades;

(h) said blades being pivotal in a verical plane and said upper mounting means comprising a wishbone bracket with arms that pivot in a horizontal plane, said arms having vertical holes for mounting same to the cavitation plate of a propeller drive housing.

4. Structure according to claim 2 wherein said propeller drive housing has a downwardly extended skeg and said lower mounting means is a bracket comprising a pair of arms straddling between said lower blade and the skeg of a propeller shaft housing to be bolted thereto.

5. An aquatic growth cutter for a submerged, water-parting portion of a vessel comprising:

(a) an upper blade having a sharp leading edge;

(b) a lower blade having a sharp leading edge and depending from said upper blade;

(c) upper mounting means mounting said upper blade to said vessel; and (d) lower mounting means mounting said lower blade to said vessel, said upper and lower mounting means mounting said blades such that same are substantially in advance said water-parting portion of a vessel to cut aquatic growth as said vessel moves through the water; and (e) said water-parting portion of a vessel comprises the leading edge of a prop housing having cololing water inlet vents, and said aquatic growth cutter including screen means passing across said intake vent to prevent same from being clogged with water-borne debris.

6. Structure according to claim 5 wherein said screen means extends rearwardly from one of said blades and rests on both sides of the propeller housing to provide positional support for said blades as well as screening action.

7. An aquatic growth cutter for a submerged, water-parting portion of a vessel comprising:

(a) an upper blade having a sharp leading edge;

(b) a lower blade having a sharp leading edge and depending from said upper blade;

(c) upper mounting means mounting said upper blade to said vessel; and (d) lower mounting means mounting said lower blade to said vessel, said upper and lower mounting means mounting said blades such that same are substantially in advance said water-parting portion of a vessel to cut aquatic growth as said vessel moves through the water; and (e) said upper blade and lower blade being pivotally fastened together to pivot in the same plane and including means to fix same together at a selected angle;

(f) said blades being so fastened together to permit them to adjustably pivot into an orientation in which said leading edges define together an angle alternatively and selectably greater or lesser than 180 degrees, and said mounting means being adapted to mount said blades to the leading edge of the keel of a sailboat, and the portion of the bottom of the sailboat adjacent the leading edge of the keel.

8. An aquatic growth cutter for a submerged, water-parting portion of a vessel comprising:

(a) an upper blade haing a sharp leading edge;

(b) a lower blade having a sharp leading edge and depending from said upper blade;

(c) upper mounting means mounting said upper blade to said vessel; and (d) lower mounting means mounting said lower blade to said vessel, said upper and lower mounting means mounting said blades such that same are substantially in advance said water-parting portion of a vessel to cut aquatic growth as said vessel moves through the water; and (e) said mounting means being both vertically adjustably connected to the respective blades and said blades being pivotally connected to permit their mutual pivoting in a vertical plane, whereby said aquatic growth cutter is multiplely adjustable to permit its mounting to a variety of propeller housings of inboard/outboard and outboard motors.

* * * * *